US008277283B2

(12) United States Patent
Sato

(10) Patent No.: US 8,277,283 B2
(45) Date of Patent: Oct. 2, 2012

(54) WAFER POLISHING METHOD AND WAFER PRODUCED THEREBY

(75) Inventor: Hiroaki Sato, Tokyo (JP)

(73) Assignee: Sumco Corporation, Tokyo (JP)

( * ) Notice: Subject to any disclaimer, the term of this patent is extended or adjusted under 35 U.S.C. 154(b) by 453 days.

(21) Appl. No.: 12/481,722

(22) Filed: Jun. 10, 2009

(65) Prior Publication Data

US 2009/0311522 A1 Dec. 17, 2009

(30) Foreign Application Priority Data

Jun. 13, 2008 (JP) ..... 2008-155763

(51) Int. Cl.
*B24B 1/00* (2006.01)

(52) U.S. Cl. ..... 451/41; 451/44; 451/57; 451/63

(58) Field of Classification Search ..... 451/41, 451/43, 44, 57, 59, 63
See application file for complete search history.

(56) References Cited

U.S. PATENT DOCUMENTS

| | | | | |
|---|---|---|---|---|
| 4,112,631 | A | 9/1978 | Howard | 51/295 |
| 5,727,990 | A * | 3/1998 | Hasegawa et al. | 451/44 |
| 6,093,087 | A * | 7/2000 | Hakomori et al. | 451/57 |
| 6,334,808 | B1 * | 1/2002 | Tanaka | 451/44 |
| 6,465,328 | B1 | 10/2002 | Hashii et al. | 438/459 |
| 6,478,660 | B2 * | 11/2002 | Hakomori et al. | 451/44 |
| 7,550,780 | B2 * | 6/2009 | Nakayama et al. | 257/171 |
| 7,601,644 | B2 | 10/2009 | Koyata et al. | 438/692 |
| 2002/0016072 | A1 | 2/2002 | Hashii et al. | 438/690 |
| 2003/0104698 | A1 | 6/2003 | Taniguchi et al. | 438/692 |
| 2005/0142882 | A1 | 6/2005 | Kida et al. | 438/692 |
| 2008/0008570 | A1 | 1/2008 | Rogers et al. | 414/292 |
| 2008/0092455 | A1 | 4/2008 | You | 51/298 |
| 2009/0311863 | A1 | 12/2009 | Hashii et al. | 438/691 |
| 2009/0311948 | A1 | 12/2009 | Hashii et al. | 451/44 |
| 2009/0311949 | A1 | 12/2009 | Hashii et al. | 451/54 |

FOREIGN PATENT DOCUMENTS

| | | | |
|---|---|---|---|
| JP | 11-188589 | A | 7/1999 |
| JP | 3328193 | B2 | 7/2002 |
| WO | WO 2005/055302 | A1 | 6/2005 |

* cited by examiner

*Primary Examiner* — Timothy V Eley

(74) *Attorney, Agent, or Firm* — Fitzpatrick, Cella, Harper & Scinto

(57) ABSTRACT

A wafer is polished by a method comprising a slicing step of cutting out a wafer from a single crystal ingot and a step of polishing at least one of both surfaces and an end face of the wafer, wherein the at least one surface and end face of the wafer are simultaneously subjected to a mirror polishing.

7 Claims, 2 Drawing Sheets

WAFER POLISHING METHOD AND WAFER PRODUCED THEREBY

BACKGROUND OF THE INVENTION

1. Field of the Invention

This invention relates to a method for polishing a wafer and a wafer produced by this method, and more particularly to a method for polishing a wafer, which is capable of reducing particles existing on an end face of the wafer with few step number.

2. Description of the Related Art

In the conventional wafer production, after a wafer is cut out from a single crystal ingot at a slicing step, at least one of both surfaces of the wafer is subjected to a mirror polishing step. For the purpose of removing particles from an end face of the wafer and improving a strength thereof, it is common to conduct a preliminary mirror polishing for finish beveling the end face of the wafer before the above mirror polishing step of the at least one surface (see JP-A-H11-188589 and WO 2005/055302).

When a wafer is produced by the above-mentioned method, as shown, for example, in FIG. 1, a polishing apparatus 100 used in the mirror polishing step of the at least one surface, e.g. front surface of a semiconductor wafer 101 is provided with a resin guide 102 for preventing the wafer from jumping out. However, when a rear surface of the wafer is mirror-polished by the polishing apparatus 100, the wafer is moved in a horizontal direction to repeatedly strike on the resin guide 102, so that there is a fear of causing scratches on the end face of the wafer. Also, a polishing slurry used in the mirror polishing step of the rear surface of the wafer enters into a space S between the end face of the wafer and the guide 102, and adheres to the end face of the wafer resulting in a problem that many particles are existent on the end face.

FIG. 2 is a schematic view showing an example of the slurry adhered to the end face of the wafer, wherein FIG. 2(*a*) is a view for explaining an observing direction 201 to a wafer 200 and FIG. 2(*b*) is a partial schematic view showing an end face 202 of the wafer 200 inclined by 45° from a standard face toward a front surface 200*a* viewing from the observing direction 201. As shown in FIG. 2(*b*), an adhered slurry aggregate (particles) 203 is existent on the end face 202 of the wafer 200. It is anticipated that this phenomenon would have a significantly bad influence on a wafer having a diameter of not less than 450 mm.

SUMMARY OF THE INVENTION

It is, therefore, an object of the invention to provide a method for polishing a wafer, which is capable of preventing a damage to an end face of the wafer and suppressing an adhesion of a polishing slurry thereto with few step number as well as a wafer being small in the number of particles existing on the end face of the wafer.

The summary and construction of the invention for achieving the above object are as follows.

(1) A method for polishing a wafer, which comprises a slicing step of cutting out a wafer from a single crystal ingot and a step of polishing at least one of both surfaces and an end face of the wafer, wherein the at least one surface and end face of the wafer are simultaneously subjected to a mirror polishing.

(2) A method for polishing a wafer according to the item (1), wherein the at least one surface of the wafer is a rear surface of the wafer.

(3) A method for polishing a wafer according to the item (1), wherein the mirror polishing of the end face is conducted with a suede type or polyurethane type end face polishing pad.

(4) A method for polishing a wafer according to the item (3), wherein the end face polishing pad has a V-shaped or round-shaped surface corresponding to a given beveling form of the end face of the wafer.

(5) A method for polishing a wafer according to the item (1), wherein the wafer has a diameter of not less than 450 mm.

(6) A wafer produced by the method according to the item (5), wherein particles existing on the end face of the wafer having a diameter of 450 mm satisfy the following relationship between particle size and particle number:

| Particle size | Particle number |
|---|---|
| not less than 35 nm | not more than 5000 particles |
| not less than 50 nm | not more than 500 particles |
| not less than 100 nm | not more than 100 particles |

In the method for polishing a wafer according to the invention, the at least one surface and end face of the wafer are simultaneously mirror-polished at the same step, whereby it is made possible to prevent a damage to an end face of the wafer and suppress an adhesion of a polishing slurry thereto with few step number, and the number of particles existing on the end face of the wafer may be reduced. Moreover, by suppressing the adhesion of the polishing slurry to the end face of the wafer is mitigated a burden in a final cleaning, whereby a surface roughness of a front surface of the wafer can be reduced.

BRIEF DESCRIPTION OF THE DRAWINGS

The invention will be described with reference to the accompanying drawings, wherein.

DESCRIPTION OF THE PREFERRED EMBODIMENTS

The method for polishing a wafer according to the invention comprises a slicing step of cutting out a wafer from a single crystal ingot and a step of polishing at least one of both surfaces and end face of the wafer and is characterized in that the at least one surface and end face of the wafer are simultaneously subjected to a mirror polishing, whereby it is made possible to prevent a damage to the end face of the wafer and suppress an adhesion of a polishing slurry thereto with few step number, and to reduce the number of particles existing on the end face of the wafer.

Figure 1:
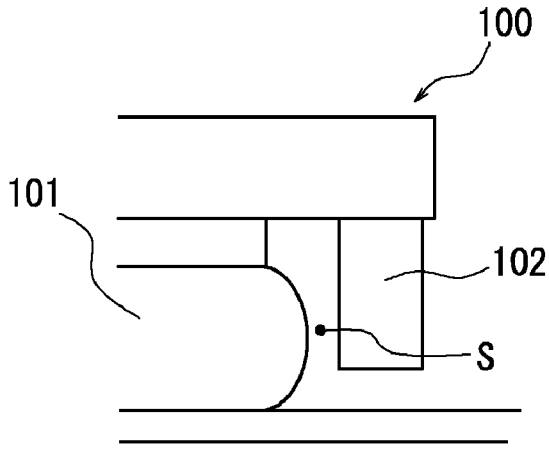
PRIOR ART FIG. 1
FIG. 1 is a schematic cross-sectional view of a polishing step according to the conventional wafer polishing method.
Figure 2:
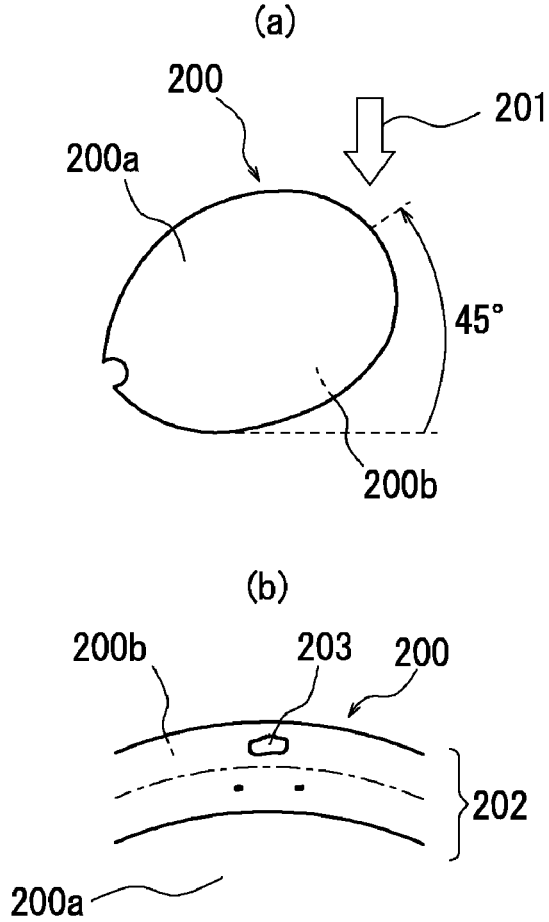
PRIOR ART FIG. 2
FIG. 2 is a schematic view showing an example of a slurry adhered to an end face of a wafer.
Figure 3:
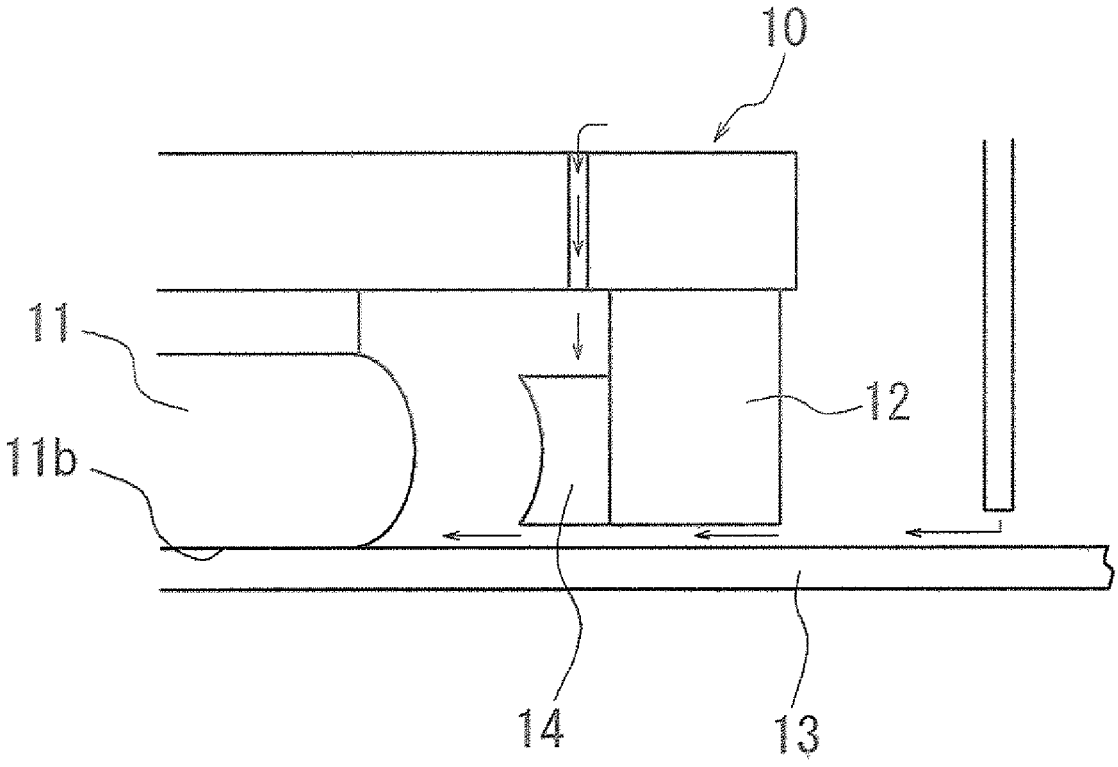
FIG. 3 is a schematic cross-sectional view of a polishing step showing an embodiment of the wafer polishing method according to the invention.

FIG. 3 is a schematic cross-sectional view of a polishing step showing one embodiment of the wafer polishing method according to the invention, which shows a polishing apparatus 10, a wafer 11, a resin guide 12 and a one-side polishing pad 13 for polishing one surface of the wafer.

The at least one surface of the wafer is preferable to be a rear surface 11*b* of the wafer. By polishing the rear surface 11*b* together with the end surface, it is possible to attain a process efficiency capable of making two processes of rear surface polishing and end face polishing to one process, and further to prevent an adhesion of a slurry to the end face of the wafer in the polishing of a front surface. Furthermore, it is more preferable to simultaneously polish the front surface of the wafer in addition to the rear surface 11*b* thereof in view that the above effect can be more enhanced.

The mirror polishing of the end face is preferable to be conducted with a suede type or polyurethane type end face polishing pad 14. Because, the suede type pad can provide a non-damaged face close to a non-disturbing state, while the polyurethane type pad is high in the polishing speed and excellent in the planarization and damage reduction. The surface of the end face polishing pad 14 may be flat-shape, V-shape or round-shape corresponding to a given beveled form of the end face of the wafer.

The method for polishing a wafer according to the invention is preferable to be applied to a wafer having a diameter of not less than 450 mm. The effect of the invention can be highly displayed in the large-diameter wafer, since there are serious problems in the conventional polishing method that when the front surface (or both surfaces) is polished by the conventional technique, scratches are caused on the end face of the wafer and the polishing slurry adheres to the end face of the wafer.

As regards the wafer produced by the polishing method according to the invention, particles (foreign fine particles) existing on the end face of the wafer having a diameter of 450 mm satisfy the following relationship between particle size and particle number:

| Particle size | Particle number |
|---|---|
| not less than 35 nm | not more than 5000 particles |
| not less than 50 nm | not more than 500 particles |
| not less than 100 nm | not more than 100 particles |

The particle size is a size of particles observed and measured by means of a commercially available scanning electron microscope (SEM). The particle number is a value of particles existing on a full circumference of an end face of a wafer measured by deliberately observing the full circumference of the end face of the wafer at an inclined state by means of the commercially available scanning electron microscope (SEM).

The particle number with a particle size of not less than 35 nm is preferable to be not more than 5000 particles. In this case, a burden in the final cleaning can be further reduced, and hence the surface roughness on the front surface of the wafer can be more reduced.

Moreover, a ratio of the number of particles existing on the front surface (mirror surface) to the number of particles existing on the end face is typically within a range of 1:100 to 1:1000.

Example 1

A wafer having a diameter of 450 mm (thickness: 925 μm) is cut out from a single crystal ingot through slicing, and then subjected to a beveling (round-shaped), a lapping (lapping amount: 125 μm), a grinding and an etching in this order, and thereafter a rear surface and an end face of the wafer are mirror-polished at the same time. The mirror polishing of the end face is conducted with a V-shaped suede type end face polishing pad.

Comparative Example 1

The polishing is conducted in the same manner as in Example 1 except that the mirror polishing of the rear surface of the wafer is conducted after the finish beveling of the end face of the wafer is conducted by the mirror polishing.

Evaluation

The results measured on the size and number of particles existing on the end face in Example 1 and Comparative Example 1 are shown in Table 1. The measurement of the size and number of particles are conducted with a scanning electron microscope (made by Hitachi, Ltd.).

TABLE 1

| Particle size | Example 1 Particle number (particles) | Comparative Example 1 Particle number (particles) |
|---|---|---|
| not less than 35 nm | about 4700 | about 650000 |
| not less than 50 nm | about 450 | about 83500 |
| not less than 100 nm | about 90 | about 2700 |

As seen Table 1, the number of particles existing on the end face is reduced in Example 1 according to the invention as compared with Comparative Example 1 as a conventional example.

In the method for polishing a wafer according to the invention, the at least one surface and end face of the wafer are simultaneously mirror-polished at the same step, whereby it is made possible to prevent a damage to an end face of the wafer and suppress an adhesion of a polishing slurry thereto with few step number, and the number of particles existing on the end face of the wafer may be reduced. Moreover, by suppressing the adhesion of the polishing slurry to the end face of the wafer is mitigated a burden in a final cleaning, whereby a surface roughness of a front surface of the wafer can be reduced.

What is claimed is:

1. A method for polishing a wafer, comprising steps of:

obtaining a wafer that is cut from a single crystal ingot, the wafer having an end face and two planar surfaces, and the wafer having a diameter of not less than 450 mm; and simultaneously mirror polishing the end face and at least one of the two planar surfaces of the wafer, wherein the mirror polishing includes:

providing a first polishing pad for polishing a first surface of the two planar surfaces of the wafer, the first polishing pad being sized to cover an entirety of the first surface of the two planar surfaces, providing a second polishing pad for polishing the end face of the wafer, the second polishing pad being supported by a guide for maintaining, during polishing, a position of the second polishing pad relative to the end face of the wafer, and a position of the first surface of the two planar surfaces of the wafer relative to the first polishing pad, and wherein the mirror polishing results in not more than 5000 particles of a size not less than 35 nm on the end face of the wafer.

2. A method for polishing a wafer according to claim 1, wherein the first surface of the two planar surfaces of the wafer is a rear planar surface of the wafer.

3. A method for polishing a wafer according to claim 1, wherein the mirror polishing of the end face is conducted with a suede type or polyurethane type end face polishing pad.

4. A method for polishing a wafer according to claim 3, wherein the end face polishing pad has a V-shaped or round-shaped surface corresponding to a given beveling form of the end face of the wafer.

5. A method for polishing a wafer according to claim 1, wherein the mirror polishing results in not more than 500 particles of a size not less than 50 nm on the end face of the wafer.

6. A method for polishing a wafer according to claim 1, wherein the mirror polishing results in not more than 100 particles of a size not less than 100 nm on the end face of the wafer.

7. A method for polishing a wafer according to claim 1, wherein the at least one of the two planar surfaces of the wafer is a front planar surface of the wafer, and wherein, after the mirror polishing step, a ratio of a number of particles on the front planar surface of the wafer to a number of particles on the end face of the wafer is in a range of 1:100 to 1:1000.

* * * * *